US006543080B1

(12) United States Patent
Tomita et al.

(10) Patent No.: US 6,543,080 B1
(45) Date of Patent: Apr. 8, 2003

(54) APPARATUS AND METHOD FOR CLEANING SEMICONDUCTOR SUBSTRATE

(75) Inventors: Hiroshi Tomita, Kanagawa-ken (JP); Soichi Nadahara, Kanagawa-ken (JP); Mitsuhiko Shirakashi, Kanagawa-ken (JP); Kenya Ito, Kanagawa-ken (JP); Yuki Inoue, Kanagawa-ken (JP)

(73) Assignee: Ebara Corporation, Tokyo (JP)

( * ) Notice: Subject to any disclaimer, the term of this patent is extended or adjusted under 35 U.S.C. 154(b) by 14 days.

(21) Appl. No.: 09/635,848

(22) Filed: Aug. 11, 2000

(30) Foreign Application Priority Data

Aug. 13, 1999 (JP) ..... 11-229356

(51) Int. Cl.[7] ..... B08B 3/12
(52) U.S. Cl. ..... 15/102; 15/88.3
(58) Field of Search ..... 15/17, 88.2, 88.3, 15/102; 134/144, 133, 184, 186, 198, 199, 902

(56) References Cited

U.S. PATENT DOCUMENTS 5,868,866 A * 2/1999 Maekawa et al.
5,975,094 A * 11/1999 Shurtiff
5,985,039 A * 11/1999 Yonemizu et al.
6,167,583 B1 * 1/2001 Miyashita et al.
6,260,562 B1 * 7/2001 Morinish et al.
6,325,081 B1 * 12/2001 Miki et al.
6,345,630 B2 * 2/2002 Fishkin et al.

* cited by examiner

*Primary Examiner*—Terrence R. Till
(74) *Attorney, Agent, or Firm*—Wenderoth, Lind & Ponack, L.L.P.

(57) ABSTRACT

A semiconductor substrate cleaning apparatus and method are capable of efficiently removing contamination from both the obverse and reverse sides of a semiconductor substrate. A single cleaning liquid supply nozzle for supplying a cleaning liquid to both the obverse and reverse sides of a semiconductor substrate to be cleaned is placed at a distance from the outer peripheral edge of the substrate. An ultrasonic vibrator applies ultrasonic waves to both the obverse and reverse sides of the substrate. Four driving rollers are disposed in contact with the outer peripheral edge of the substrate. The driving rollers are adapte to rotate while being engaged with the outer peripheral edge of the substrate thereby drivingly rotating the substrate.

18 Claims, 16 Drawing Sheets

APPARATUS AND METHOD FOR CLEANING SEMICONDUCTOR SUBSTRATE

BACKGROUND OF THE INVENTION

The present invention relates to an apparatus and method for cleaning a semiconductor substrate.

Recently, demands for exceptionally fine wiring patterns in semiconductor devices have become the norm. Not only are there increasing demands being made for device downsizing, but also for improved reliability in such devices. As the distance between wiring patterns decreases, it becomes increasingly important to avoid contamination of substrate surfaces with particulate and other contaminants, in order to prevent the occurrence of short circuits and other defects. Consequently, cleaning of semiconductor substrates is now required to be carried out at various steps in semiconductor manufacturing processes.

In this connection, a cleaning technique presently employed in CMP (Chemical/Mechanical Polishing) will be described below by way of example.

In CMP, an abrasive such an $Al_2O_3$, $SiO_2$, and $CeO_x$ in a slurry or polishing liquid adheres to a wafer surface after polishing. In the case of a silicon wafer with a diameter of 200 mm, about 4 to $4\times10^4$ particles of 0.2 microns in diameter adhere to the wafer surface. The wafer surface in this state is subjected to both primary and secondary cleaning processes as described below.

In the primary cleaning process, the wafer is held by a plurality of driving rollers which are engaged with the peripheral edge of the wafer, and the driving rollers are rotated to cause the wafer to be rotated about an axis. Sponge rollers are then pressed against opposite sides or obverse and reverse sides of the rotating wafer so as to remove from its surface any particles including abrasive particles and debris which have become detached from the wafer. However, in the case of a wafer having recesses formed on its surfaces, sponge rollers are unable to be brought into adequate contact with the wafer surface due to the existence of the recesses.

The secondary cleaning process will be described below with reference to FIG. 21. FIG. 21 is a conceptual view of a cleaning apparatus used in the cleaning process. The silicon wafer 1, which has already been subjected to the primary cleaning process, is held by a plurality of driving rollers (not shown) which are engaged with the peripheral edge of the wafer. Rotation of the driving rollers causes the wafer 1 to rotate about an axis in the direction of the arrow. An ultrasonic nozzle 31 is provided above the surface of the wafer 1. The ultrasonic nozzle 31 is operated to move in a diametrical direction of the wafer. A cleaning liquid 33 is applied to the wafer 1 from the nozzle 31 to remove any particles remaining on the surface of the wafer 1. It should be noted that in the secondary cleaning process, ultrasonic vibrations are imparted to the cleaning liquid 33 by an ultrasonic vibrator incorporated in the nozzle 31 in order to effect propagation of vibrations to the surface of the wafer 1 through the cleaning liquid 33. The application of ultrasonic vibrations to the wafer 1 enables cleaning to be enhanced greatly as a result of a synergistic effect obtained by a combination of a chemical cleaning effect provided by the cleaning liquid and a direct physical cleaning effect induced by ultrasonic vibrations imparted to the wafer under cleaning.

However, the cleaning apparatus shown in FIG. 21 involves a problem in that a relatively long amount of time is required in order to complete a cleaning process. FIG. 22 is a conceptual view of a cleaning apparatus comprising an elongated nozzle 41, which was devised to shorten a required cleaning time. As shown in FIG. 22, a wafer 1 is held and rotated by driving rollers engaged with the peripheral edge thereof. The elongated nozzle 41 is placed above the wafer to extend in a diametrical direction of the wafer 1. The elongated nozzle supplies a cleaning liquid imparted under ultrasonic vibrations along the entire length of the diameter of the water, whereby the cleaning time can be shortened in comparison to a cleaning apparatus as shown in FIG. 21.

However, this highly efficient cleaning effect obtained by the cleaning apparatus shown in FIGS. 21 and 22, is performed only with respect to the obverse side of a wafer facing the nozzle of the cleaning apparatus, and the cleaning effect obtained at the reverse side is inferior to that obtained at the obverse side. Although adoption of a cleaning process whereby the wafer is turned around to effect cleaning of the reverse side is conceivable, such a process would double the amount of time required to clean a wafer. There has also been proposed a cleaning method wherein a wafer is dipped in its entirety into a cleaning liquid with ultrasonic waves being imparted to the wafer once it is immersed in the cleaning liquid. However, this method is subject to a problem in that it causes an uneconomic increase in the amount of chemical liquid used. In addition, particles, including abrasive particles removed from the wafer, tend to adhere to the wall of a vessel in which the cleaning liquid is contained. Adhesion of such particles has the potential to cause adverse effects during cleaning of a wafer.

The object of the present invention is to overcome the problems described in the foregoing passages. In particular, these problems include a highly efficient cleaning effect that can be obtained only with respect to a wafer surface facing an ultrasonic vibrator, and a cleaning effect obtained at the reverse side that is inferior to that obtained at the obverse side.

SUMMARY OF THE INVENTION

In view of the above-described problems with the prior art, an object of the present invention is to provide a semiconductor substrate cleaning apparatus and method capable of efficiently removing contamination from both the obverse and reverse sides of a semiconductor substrate.

The present invention provides a semiconductor substrate cleaning apparatus including a cleaning liquid supply nozzle for supplying a cleaning liquid to both the obverse and reverse sides of a semiconductor substrate to be cleaned. The cleaning apparatus further includes an ultrasonic vibrator for applying ultrasonic waves to both the obverse and reverse sides of the semiconductor substrate.

Preferably, the ultrasonic vibrator is placed in contact with the semiconductor substrate to apply vibrations directly to the semiconductor substrate. Alternatively, the ultrasonic vibrator is placed at a distance from the semiconductor substrate to apply vibrations to the semiconductor substrate through the cleaning liquid or a protective member disposed between the ultrasonic vibrator and the semiconductor substrate.

Preferably, the cleaning apparatus is provided with a plurality of retaining jigs placed in contact with the outer peripheral edge of the semiconductor substrate. The retaining jigs are adapted to rotate while being pressed against the outer peripheral edge of the semiconductor substrate, thereby retaining and rotating the semiconductor substrate. More desirably, the retaining jigs each incorporate the ultrasonic vibrator.

Preferably, the cleaning apparatus has sponge rollers provided for both the obverse and reverse sides of the semiconductor substrate. The sponge rollers are adapted to rotate in contact with the semiconductor substrate, thereby removing contamination from both the obverse and reverse sides of the semiconductor substrate. Preferably, the vibration frequency of the ultrasonic vibrator is in the range of from 200 kHz to 700 kHz. The most suitable vibration frequency of the ultrasonic vibrator is in the range of from 400 kHz to 500 kHz.

It should be noted that the cleaning apparatus may have a single ultrasonic vibrator or a plurality of ultrasonic vibrators and a single cleaning liquid supply nozzle or a plurality of cleaning liquid supply nozzles. However, preferably a single vibrator and a single nozzle are employed in such a manner that the vibrator is incorporated in the nozzle. In this case, it is preferable that the cleaning liquid is discharged from the nozzle as a jet towards the peripheral edge of the semiconductor substrate with an angle in a range from ±10 to 20° with respect to the surface of the semiconductor substrate. In a case where a plurality of ultrasonic vibrators are provided, the ultrasonic vibrators are provided in symmetry with respect to the surface of the semiconductor substrate, and ultrasonic vibrations having the same characteristics are imparted to the semiconductor substrate at the same angle and in symmetry between the obverse and reverse sides of the semiconductor substrate.

It is desirable that the pH of the cleaning liquid be not less than 7.

In addition, the present invention provides a semiconductor substrate cleaning method wherein a cleaning liquid is supplied simultaneously to both the obverse and reverse sides of a semiconductor substrate to be cleaned, and ultrasonic waves are imparted to both the obverse and reverse sides of the semiconductor substrate, thereby cleaning the semiconductor substrate.

In the present invention, a cleaning liquid having ultrasonic vibrations is simultaneously supplied from the cleaning liquid supply nozzle to both the obverse and reverse sides of the semiconductor substrate. Accordingly, the obverse and reverse sides of the semiconductor substrate can be cleaned simultaneously. Therefore, the cleaning time can be shortened. Because the cleaning liquid is supplied from the nozzle, the amount of chemical liquid used is reduced even in comparison to the dipping type cleaning process in which the whole semiconductor substrate is dipped in the cleaning liquid.

By providing each retaining jig with an ultrasonic vibrator for imparting ultrasonic vibrations to the cleaning liquid, ultrasonic vibrations can be applied simultaneously to the obverse and reverse sides of the semiconductor substrate.

By adopting a structure in which the ultrasonic vibrators provided in the driving rollers are placed in direct contact with the semiconductor substrate, ultrasonic vibrations can be applied directly to the semiconductor substrate without using the cleaning liquid as a vibration medium. Thus, ultrasonic vibrations can be continuously applied in the diametrical direction of the semiconductor substrate by shock waves passing through the semiconductor substrate.

In a case where a single ultrasonic vibrator and a single cleaning liquid supply nozzle are intergrated into one unit, ultrasonic vibrations can be imparted to a side of the semiconductor substrate from the nozzle tip. Therefore, it is possible to clean both the obverse and verse sides of the semiconductor substrate simultaneously and to minimize the costs of the By providing the cleaning apparatus with sponge rollers for cleaning, it becomes to clean the semiconductor substrate by a single cleaning process in contrast to the conventional system that requires two steps for cleaning. Accordingly, the cleaning time can be shortened, and the cleaning effect is improved remarkably.

The above and other objects, features and advantages of the present invention will more apparent from the following description of the preferred embodiments thereof, taken in conjuction with the accompanying drawings.

BRIEF DESCRIPTION OF THE DRAWINGS

FIG. 1(*b*) is a plan view of the apparatus of FIG. 1.

FIG. 3(*b*) is a photomicrograph showing particles remaining on the obverse surface of the semiconductor substrate after a cleaning experiment has been conducted using an apparatus for cleaning according to the first embodiment of the present invention.

FIG. 3(*c*) is a photomicrograph showing particles remaining on a reverse surface of a semiconductor substrate before the surface is subjected to cleaning.

FIG. 3(*d*) is a photomicrograph showing particles remaining on the reverse surface of the semiconductor substrate after a cleaning experiment has been conducted using an apparatus for cleaning according to the first embodiment of the present invention.

FIGS. 6(*d*), 6(*e*) and 6(*f*) are photomicrographs showing particles remaining on a semiconductor substrate after experimental cleaning has been carried out with 400 kHz vibrations for ten seconds, twenty seconds and thirty seconds, respectively.

FIGS. 7(*d*), 7(*e*) and 7(*f*) are photomicrographs showing particles remaining on a semiconductor substrate after experimental cleaning has been carried out with 700 kHz vibrations for ten seconds, twenty seconds and thirty seconds, respectively.

FIG. 12(*b*) is a side elevation view of the apparatus of FIG. 12(*a*).

FIG. 13(*b*) is a plan view of the apparatus of FIG. 13(*a*).

FIG. 15(*b*) is a plan view of the apparatus of FIG. 15(*a*).

DETAILED DESCRIPTION OF THE INVENTION

Embodiments of the present invention will be described below with reference to the accompanying drawings.

FIRST EMBODIMENT

Figure 1A:
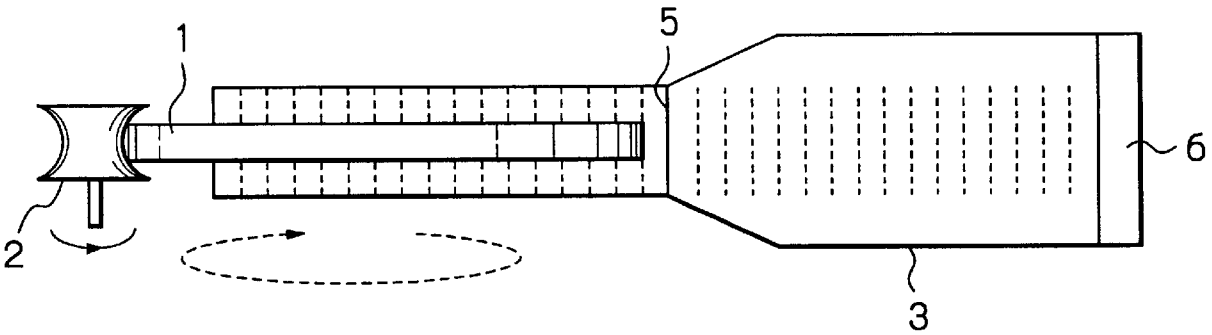
FIG. 1(*a*) is a side elevation view of a semiconductor substrate cleaning apparatus according to a first embodiment of the present invention.
Figure 1B:
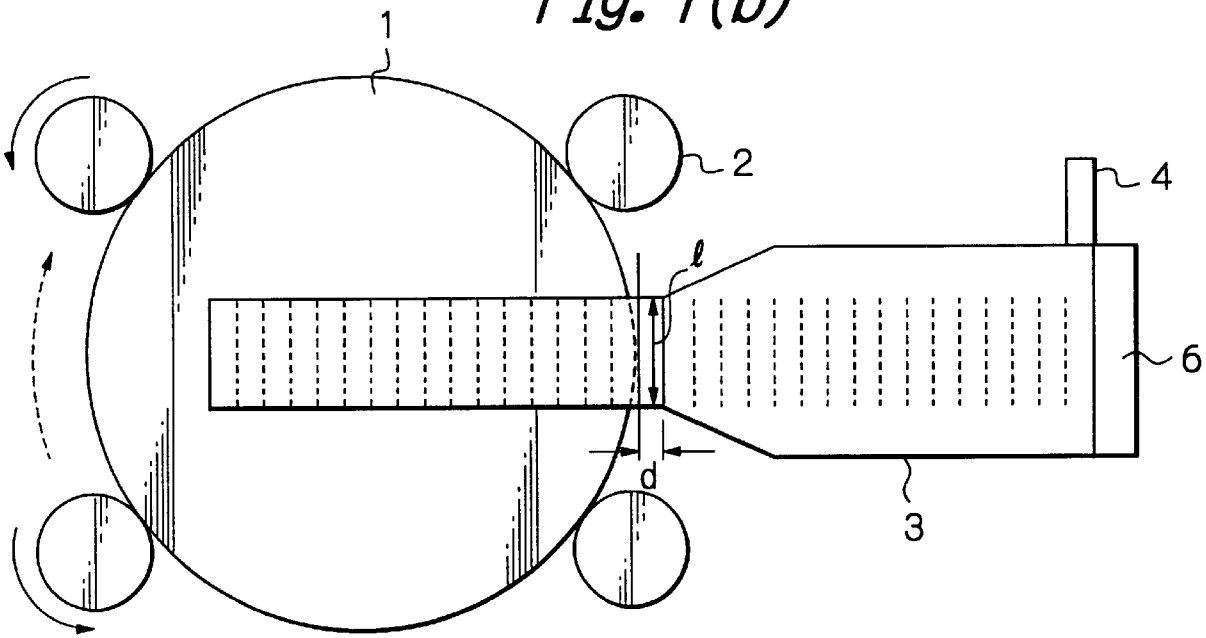

FIG. 1 shows a semiconductor substrate cleaning apparatus in accordance with a first embodiment of the present invention, which is engaged in a polishing operation: FIG. (*a*) is a side elevation view; and FIG. 1(*b*) is a plan view of the same.

The cleaning apparatus is provided with four driving rollers 2 which are spaced apart from each other at equal angular distances around a semiconductor wafer 1 having the shape of a disc in such a manner that they engage a peripheral edge of the wafer 1. The driving rollers 2 each have a rotating shaft extending normal to the surface of the wafer 1 and are operated to rotate the wafer 1 about a center axis of the wafer 1. The rotational speed of the wafer is in the range of from several tens to several hundreds of revolutions per minute. The rotating shafts of the driving rollers 2 are movable along the outer periphery of the wafer 1 or about the center axis of the wafer.

The cleaning apparatus further includes an ultrasonic-vibration nozzle 3 provided with an ultrasonic vibrator 6. The nozzle 3 is provided with a cleaning liquid inlet 4 and a cleaning liquid outlet 5. The nozzle 3 is placed in the vicinity of and outside the periphery of the wafer 1 in such a manner that the liquid outlet 5 is directed towards the wafer 1. The nozzle 3 is provide with a cleaning liquid through the liquid inlet 4, with the liquid being discharged through the liquid outlet 5 towards the wafer 1 in such a manner that the cleaning liquid is applied to both the obverse and reverse sides of the wafer 1. The discharged cleaning liquid is imparted with ultrasonic vibrations generated by the ultrasonic vibrator 6. A series of dotted lines in FIG. 1 show the travel paths of ultrasonic wavefronts.

Because ultrasonic vibration waves have a strong tendency towards rectilinear propagation, a distance d between the wafer 1 and the liquid outlet 5 of the nozzle is not limited by the propagation conditions of ultrasonic waves. However, in order to appropriately supply the cleaning liquid to opposite sides of the wafer 1, it is preferable that the distance d be restricted to 10 mm to 20 mm or less. However, taking into account the effect of liquid pressure, it is not strictly necessary to restrict the distance d to this range.

A diameter 1 of the liquid outlet 5 of the nozzle is generally required to be at least 1 mm. It is generally desirable for the outlet diameter 1 to be in a range of from, 5 mm to 50 mm.

As a cleaning liquid, pure water or a chemical cleaning liquid are used. Examples of a chemical cleaning liquid are acidic or alkaline aqueous solutions, such as hydrochloric acid, aqueous ammonia, hydrofluoric acid, hydrogen peroxide solution, ozonized water and electrolytically ionized water (acid water or alkali water), oxidizing or reducing chemical liquids, and anionic or nonionic surface active agents. It is particularly desirable to use an alkaline aqueous solution or anionic surface active agent having a pH of not less than 7.

The flow rate of the cleaning liquid supplied is desirably in the range of from several hundred cubic centimeters per minute to several liters per minute, although this depends on the nozzle width 1 of the ultrasonic vibration nozzle 3.

Next, a semiconductor substrate cleaning method using the above-described cleaning apparatus will be described.

Figure 2:
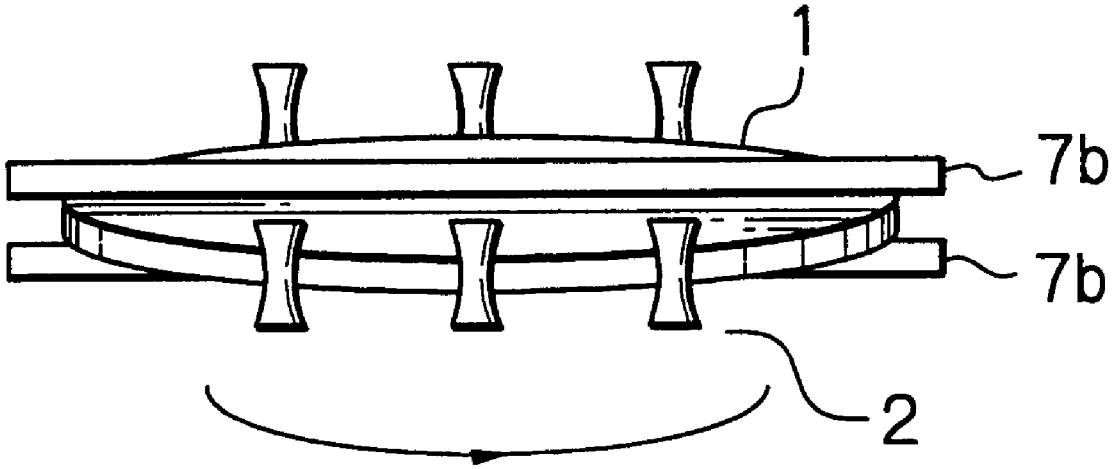
FIG. 2 is a conceptual view of sponge roller cleaning apparatus used in a semiductor substrate cleaning method according to the present invention.
Figure 3A:
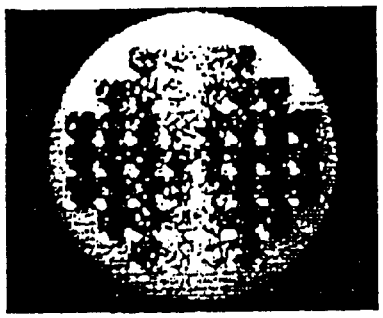
FIG. 3(*a*) is a photomicrograph showing particles remaining on an obverse surface of a semiconductor substrate before the surface is subjected to cleaning.
Figure 3C:
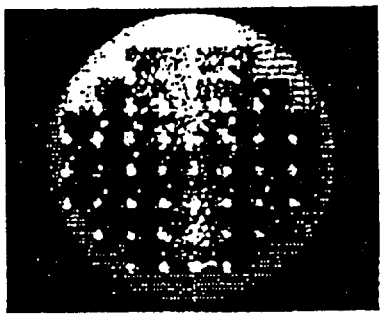
Figure 3B:
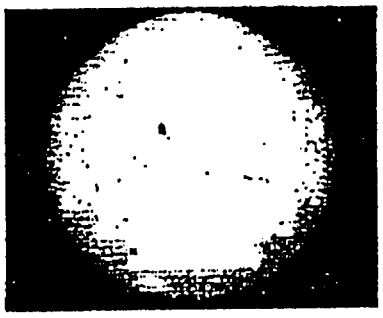
Figure 3D:
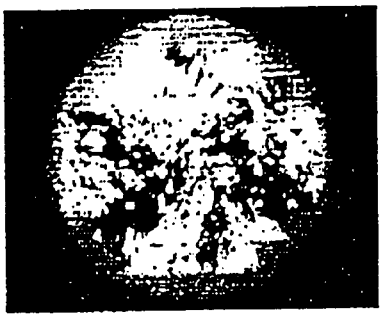

First, cleaning with sponge rollers as shown in FIG. 2 is carried out as a primary cleaning process prior to a secondary cleaning process being carried out, as shown in FIG. 1. During cleaning employing sponge rollers, a cleaning liquid consisting essentially of aqueous ammonia having a pH of about 10, for example, is supplied to both the obverse and reverse sides of the wafer 1 from a chemical liquid supply nozzle (not shown). In addition, cylindrical sponge rollers 7*a* and 7*b*, which function in such a manner as to be capable of advancing toward and retracting from the obverse and reverse sides, respectively, of the wafer 1, are pressed against the obverse and reverse sides of the wafer 1. During advancement and retraction motions, the driving rollers 2 are also rotated. Thus, while the wafer 1 is being rotated, the sponge rollers 7*a* and 7*b* are also rotated in order to remove any contamination such as particles and metallic impurities adhering to either the obverse or reverse sides of the wafer 1.

Following cleaning with the sponge rollers, ultrasonic cleaning using the apparatus shown in FIG. 1 is carried out as follows.

First, the wafer 1 is rotated by rotating the driving rollers 2 as in the primary cleaning operation. The ultrasonic vibration nozzle 3 is placed at a predetermined distance d from the outer peripheral end surface of the wafer 1. The nozzle outlet 5 is adjusted so that the application angle is 0° with respect to the surface of the wafer 1. Then, the cleaning liquid is supplied to the wafer 1 from the liquid inlet 4 through the ultrasonic vibration nozzle 3. Both the obverse and reverse sides of the wafer 1 are soaked with the supplied cleaning liquid.

Following this, ultrasonic vibrations are imparted from the ultrasonic vibrator 6. Ultrasonic vibrations generated by the ultrasonic vibrator 6 are imparted to the wafer 1 from the ultrasonic vibration nozzle 3 through the cleaning liquid discharged from the nozzle outlet 5. Due to the overriding tendency of ultrasonic waves to propagate in a rectilinear manner, such waves can be imparted to both the obverse and reverse sides of the wafer 1 which are soaked with the cleaning liquid. The application of ultrasonic vibration waves to the obverse and reverse sides of the wafer 1 allows contamination such as particles and metallic impurities adhering to the wafer 1 to be removed from both the obverse and reverse sides simultaneously. Further, since ultrasonic cleaning is carried out while the wafer 1 is being rotated, the entire surface area of both the obverse and reverse sides of the wafer 1 are subject to the desired cleaning effect.

In summary, according to this embodiment, when ultrasonic cleaning is carried out following the primary cleaning by means of the sponge rollers, both the obverse and reverse sides of the wafer 1 to be cleaned are simultaneously supplied with a cleaning liquid from the ultrasonic vibration nozzle 3 placed at the outer peripheral end surface of the wafer 1, with ultrasonic waves being generated from the nozzle 3. The resulting ultrasonic vibrations are imparted simultaneously to both the obverse and reverse sides of the wafer 1 by way of the cleaning liquid. Therefore, both the obverse and reverse sides of the wafer 1 can be cleaned simultaneously, thereby reducing the time required for cleaning a wafer. In addition, because the cleaning apparatus is required to be fitted with only a single ultrasonic vibrator 6, the costs of the apparatus can also be reduced.

FIG. 3 shows experimental data obtained from an evaluation of the effect of cleaning carried out by the above-described cleaning method. In this experiment, a silicon wafer having an SiN film deposited on the surface thereof to a thickness of 2200 Å, with irregularities showing relatively large differences in height on the surface thereof resulting from the patterns formed thereon, was used as an object to be cleaned. FIG. 3(*a*) and FIG. 3(*b*) of FIG. 3 are both photomicrographs showing the results of measurement of the distribution of particles adhering to the obverse side of the wafer, obtained by using a particle counter (AIT-8000, manufactured by KLA-Tencor), and FIGS. 3(*c*) and 3(*d*) of FIG. 3 are photomicrographs showing particle distribution on the reverse side of the wafer. FIGS. 3(*a*) and 3(*c*) show the conditions of the obverse and reverse sides, respectively, of the wafer observed after contamination with $Al_2O_3$, and FIGS. 3(*b*) and 3(*d*) show the conditions of the two sides of the wafer after ultrasonic cleaning. It will be evident from these photomicrographs that $Al_2O_3$ particles attached to the wafer were satisfactorily removed from both the obverse and reverse sides by means of ultrasonic cleaning.

Figure 4:
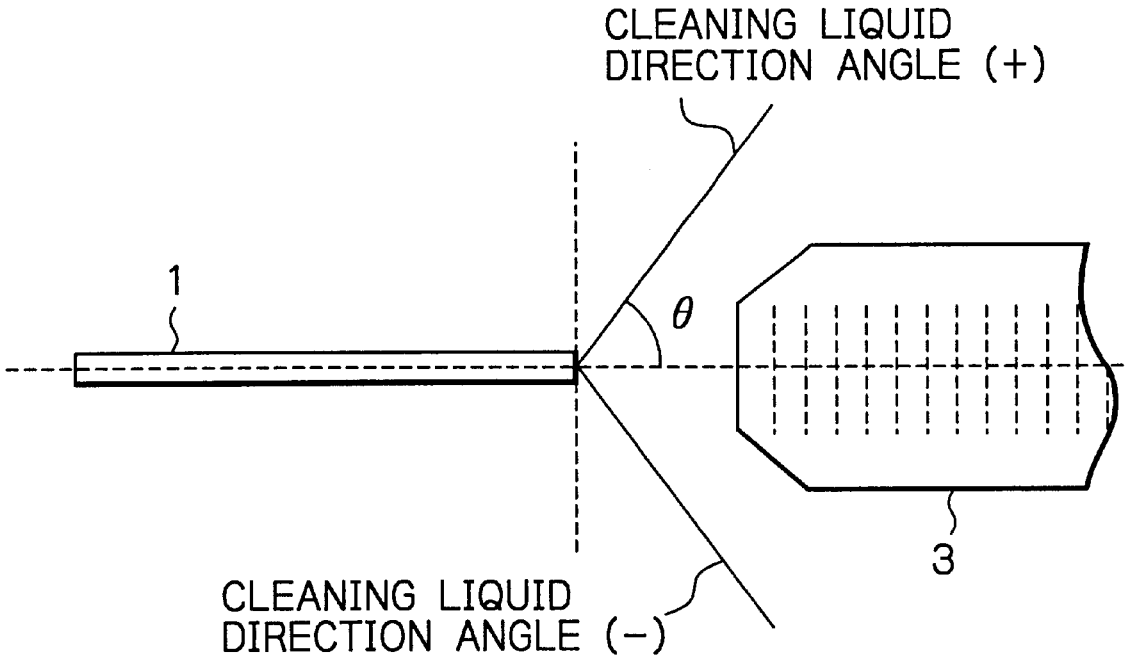
FIG. 4 is a conceptual view showing a state where the application angle of an ultrasonic nozzle with respect to a substrate is changed in the first embodiment of the present invention.
Figure 5:
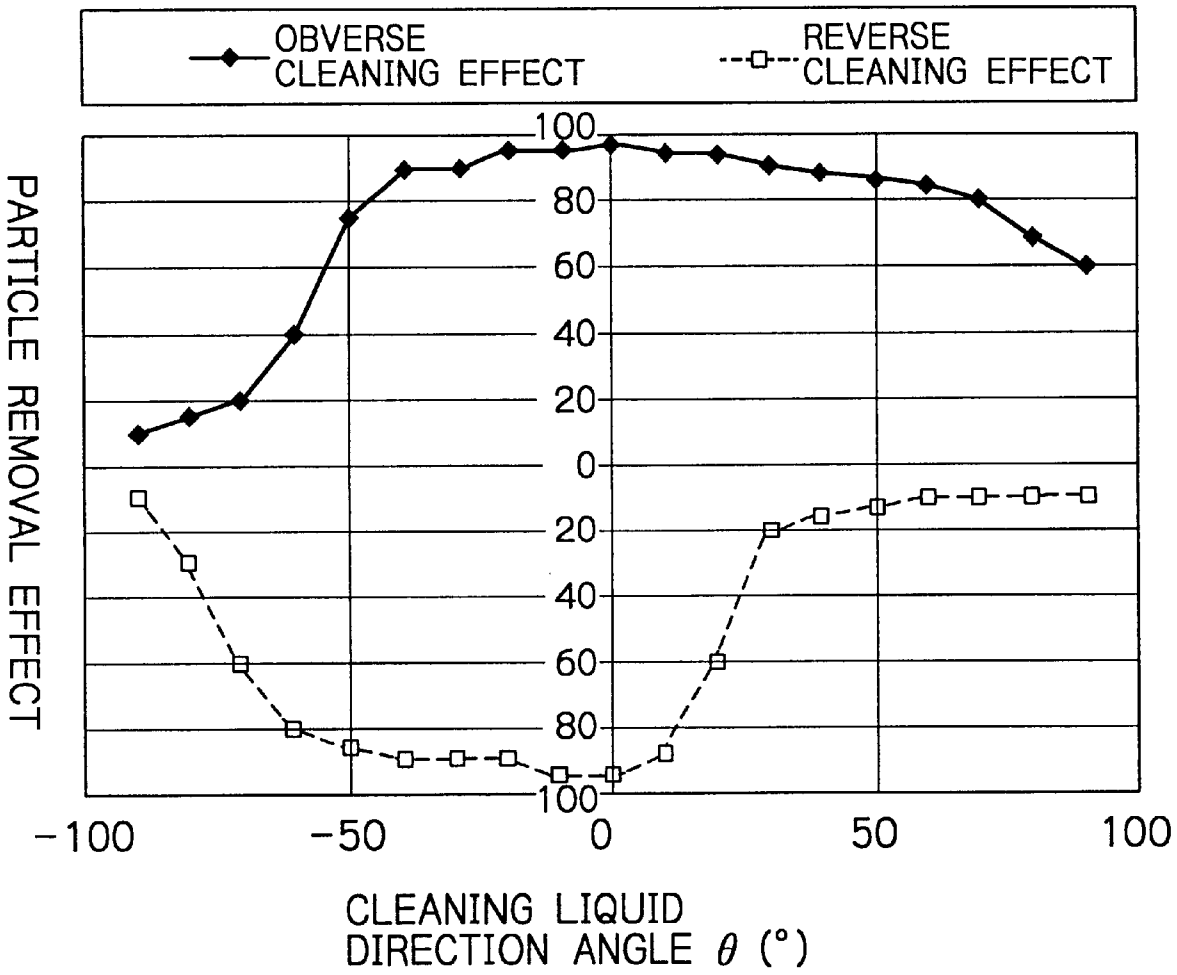
FIG. 5 is a diagram showing the relationship between the application angle θ of the ultrasonic nozzle with respect to the substrate and the particle removing effect in the first embodiment of the present invention.
Figure 6A:
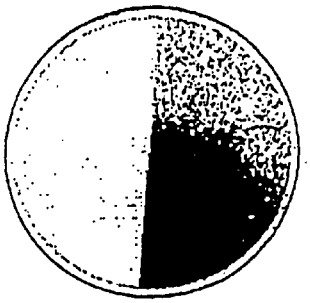
FIGS. 6(*a*), 6(*b*) and 6(*c*) are photomicrographs showing particles remaining on a semiconductor substrate after experimental cleaning has been carried out with 200 kHz vibrations for ten seconds, twenty seconds and thirty seconds, respectively.
Figure 6D:
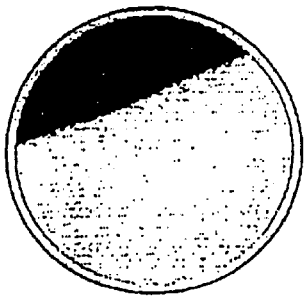
Figure 6B:
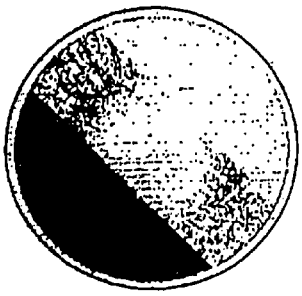
Figure 6E:
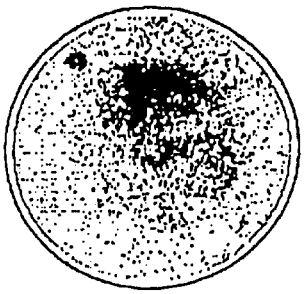
Figure 6C:
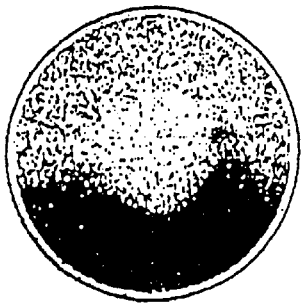
Figure 6F:
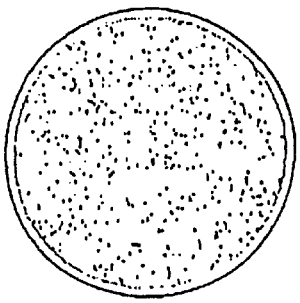
Figure 7A:
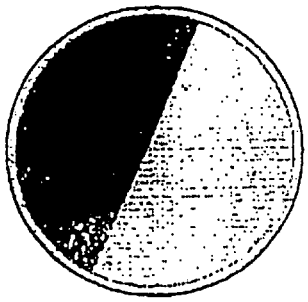
FIGS. 7(*a*), 7(*b*) and 7(*c*) are photomicrographs showing particles remaining on a semiconductor substrate after experimental cleaning has been carried out with 500 kHz vibrations for ten seconds, twenty seconds and thirty seconds, respectively.
Figure 7D:
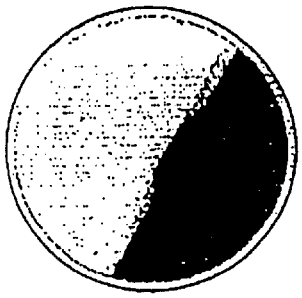
Figure 7B:
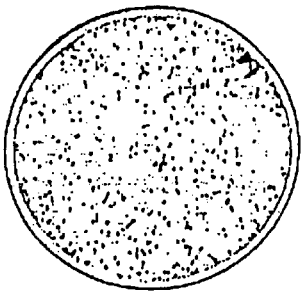
Figure 7E:
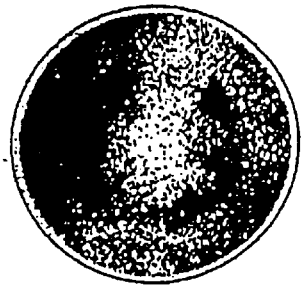
Figure 7C:
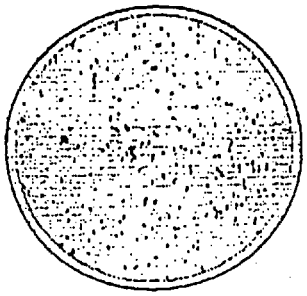
Figure 7F:
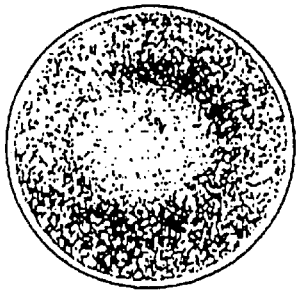

With reference to FIGS. 4 and 5, a relationship between an angle at which a cleaning liquid is directed to a wafer 1 and a cleaning effect will be discussed. When the wafer 1 is placed in a plane along which a path of the cleaning liquid discharged from the nozzle 3 lies, that is, the angle θ=0°, approximately the same amount of cleaning liquid is supplied to both the obverse and reverse sides of the wafer 1. When the ultrasonic vibration nozzle 3 is directed towards the wafer 1 from a position above the wafer 1, the cleaning liquid direction angle θ becomes positive. In this case, the amount of cleaning liquid supplied to the reverse or lower side of the wafer 1 decreases. As a result, the cleaning effect obtained thereby is reduced significantly. On the other hand, when the cleaning liquid is supplied from a position below the wafer, that is, at a position where the angle θ is negative, the cleaning liquid is supplied to the obverse or upper side of the wafer 1 as well as the reverse side of the same.

FIG. 5 shows a particle removing effect when the cleaning liquid direction angle θ is varied as described above. The abscissa axis shows the angle θ and the ordinate axis shows the particle removing effect.

With respect to both the obverse and reverse sides of the wafer 1, a satisfactory particle removing effect is obtained when the application angle θ is in the vicinity of 0°. The reason is that when the application angle θ is 0°, a sufficient volume of both cleaning liquid and ultrasonic waves are supplied to both the obverse and reverse sides of the wafer 1. When the angle θ is shifted to the negative side, a satisfactory particle removing effect is obtained for both the obverse and reverse sides of the wafer 1 in the angle range of from 0° to about −50°, whereas when the angle θis shifted to the positive side, the cleaning effect with respect to the reverse side is caused to rapidly reduce in an angle range of 0° to 50°, although the obverse cleaning effect is maintained. The reason is that when the cleaning liquid is applied obliquely downward to the wafer 1, the cleaning liquid is not sufficiently supplied to the reverse side of the wafer 1.

When the angle θ is shifted to the negative side, it becomes impossible to supply the cleaning liquid to the entire surface of the wafer 1. When the angle θ is shifted to the negative side beyond from −60° to −70°, the cleaning effect is caused to be reduce remarkably. Regarding the cleaning effect at the obverse side, a high cleaning effect is obtained as far as about ±60° because the cleaning liquid is supplied also to the obverse side in this application angle range. However, in the vicinity of ±80° to 90°, the cleaning effect is caused to be reduced due to the influence of reflected waves.

It will be understood from the above that it is desirable with a view to obtaining a satisfactory particle removing effect at both the obverse and reverse sides of the wafer 1 that the cleaning direction angle θ be set within the range of ±10° to 20°, ideally at 0°.

FIGS. 6 and 7 are photornicrographs of the wafer 1 taken during evaluation of the cleaning effect at various ultrasonic wave frequencies. FIGS. 6(*a*) to 6(*c*) are photoricrographs showing ultrasonic waves being imparted at a frequency of 200 kHz; FIGS. 6(*d*) to 6(*f*) are photomicrographs showing a frequency of 400 kHz; FIGS. 7(*a*) to 7(*c*) are photomicrographs showing a frequency of 500 kHz; and FIGS. 7(*d*)

to 7(*f*) are photomicrographs showing a frequency of 700 kHz. At 200 kHz, even when cleaning was carried out for 30 seconds, particles were not sufficiently removed. However, in a range of 80 mm in diameter from the center of the wafer, particles were removed satisfactorily. At 400 kHz, a satisfactory cleaning effect was obtained over the entire surfaces of the wafer when cleaning was carried out for only 10 seconds. When cleaning was carried out for 30 seconds, particles were mostly removed. At 500 kHz, a satisfactory cleaning effect was obtained with respect to the entire surfaces of the wafer, as in the case of utilizing a frequency of 400 kHz. Particles were further removed when cleaning was carried out for 30 seconds. At 700 kHz, particles were removed only in a range of 80 mm in diameter from the center of the wafer, even when cleaning was carried out for 30 seconds. However, particles were sufficiently removed from an area in a range of 80 mm in diameter, where cleaning was satisfactorily effected. The cleaning effect was slightly higher than in the case when a frequency of 200 kHz was employed.

Figure 8:
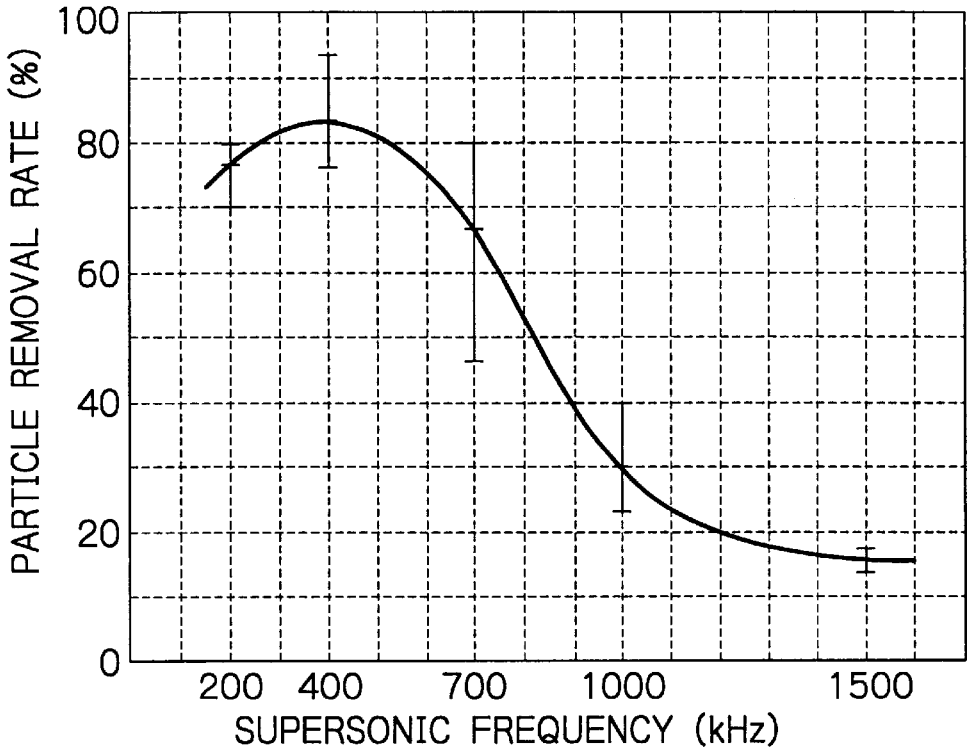
FIG. 8 is a diagram showing the necessity for employing ultrasonic vibration in obtaining a satisfactory cleaning effect for a bare or pre-processed wafer in the first embodiment of the present invention.

FIG. 8 shows the effect of ultrasonic frequencies in removing particles. The measurement was carried out under the following conditions: an object to be cleaned was a bare wafer; the number of revolutions of the wafer was 100 rpm; the number of oscillations of the arm was 3; the arm oscillating speed was 5 mm/sec.; the nozzle angle was 45°; and the flow rate of the cleaning liquid was 5.0/min. at 200 to 700 kHz and 1.2/min. at 1 to 1.5 MHz. It will be understood from FIG. 8 that the cleaning effect peaks at a frequency in the range of from 400 kHz to 500 kHz and is gradually reduced on both sides of the peak as in the case of the photomicrographs of FIGS. 6 and 7.

Figure 9:
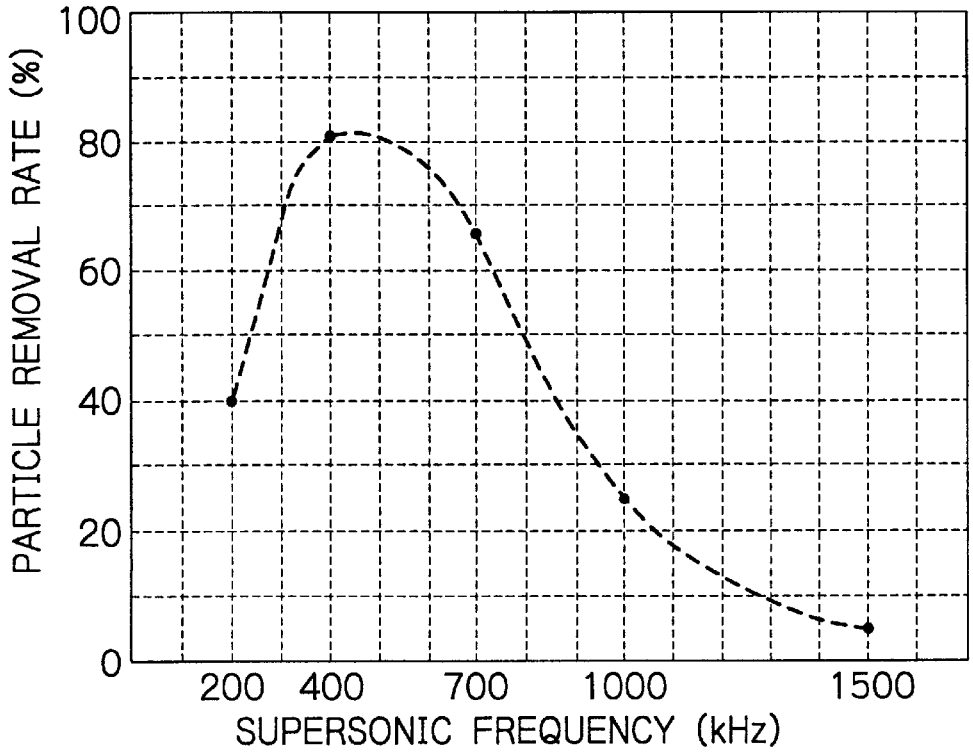
FIG. 9 is a diagram showing the results of an experiment in which the necessity for employing ultrasonic vibration in obtaining a satisfactory cleaning effect was measured using a wafer having an SiN pattern etched thereon, in the first embodiment of the present invention.

The particle removing effect also depends on the type of the object to be cleaned. FIG. 8 shows the cleaning effect with respect to a bare wafer, and how it differs from that of the case of cleaning a wafer having a recess pattern formed thereon. FIG. 9 shows an ultrasonic frequency dependence of the rate of removal of particles in a case where a silicon wafer having an SiN film deposited on the surface thereof to a thickness of 2200 Åand showing relatively large variations in surface height due to the existence of patterns formed thereon was used as an object to be cleaned. It will be understood from FIG. 9 that the cleaning effect peaks at an ultrasonic frequency in the range of from 400 kHz to 500 kHz as in the case of an bare wafer, and the cleaning effect rapidly deteriorates as the frequency increases or decreases from the optimum peak level. It has heretofore been considered to be appropriate to use ultrasonic vibrations imparted at a frequency in the order of 1 MHz in order to discharge particles from recesses on a wafer having a recess pattern formed thereon in order to remove particles from the wafer effectively. However, the results of this experiment show that the optimum frequency to be employed lies within a range of 400 kHz to 500 kHz.

Figure 10:
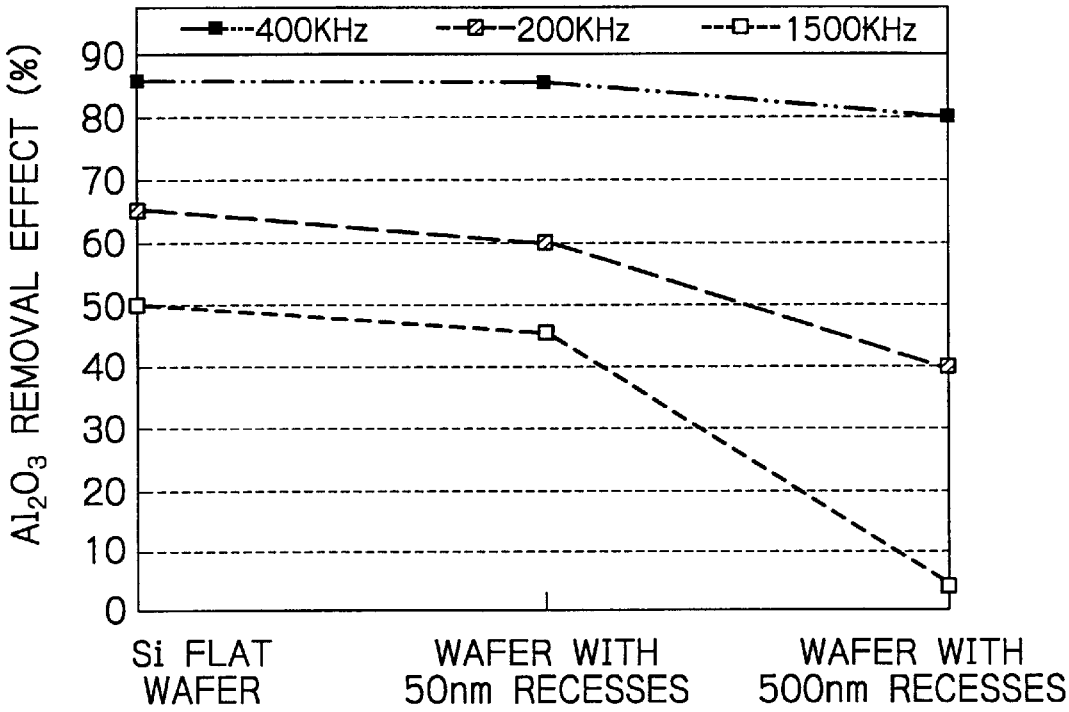
FIG. 10 is a diagram showing cleaning effects obtained at various ultrasonic frequencies to a wafer.

FIG. 10 shows the results of an experiment in which the cleaning effect was evaluated with respect to various objects at various ultrasonic frequencies. In the case of a flat bare wafer, there is no great difference in the $Al_2O_3$ particle removing effect between cleaning operations using various frequencies, i.e. 1500 kHz and 200 kHz, including a cleaning operation using a frequency of 400 kHz. In the case of a wafer having a recess pattern of 50 mm or having a recess pattern of 500 nm formed thereon, the capacity to remove particles is reduced considerably when an ultrasonic frequency of 1500 kHz or 200 kHz is employed. The $Al_2O_3$ particle removing effect is reduced generally in proportion to the magnitude of irregularities in the recess pattern. In the case of using an ultrasonic frequency of 400 kHz, a satisfactory cleaning effect can be obtained regardless of the magnitude of irregularities of the recess pattern. Thus, it can be understood that an ultrasonic frequency of around 400 kHz is particularly suitable for cleaning a wafer on which a recess pattern has been formed.

Figure 11:
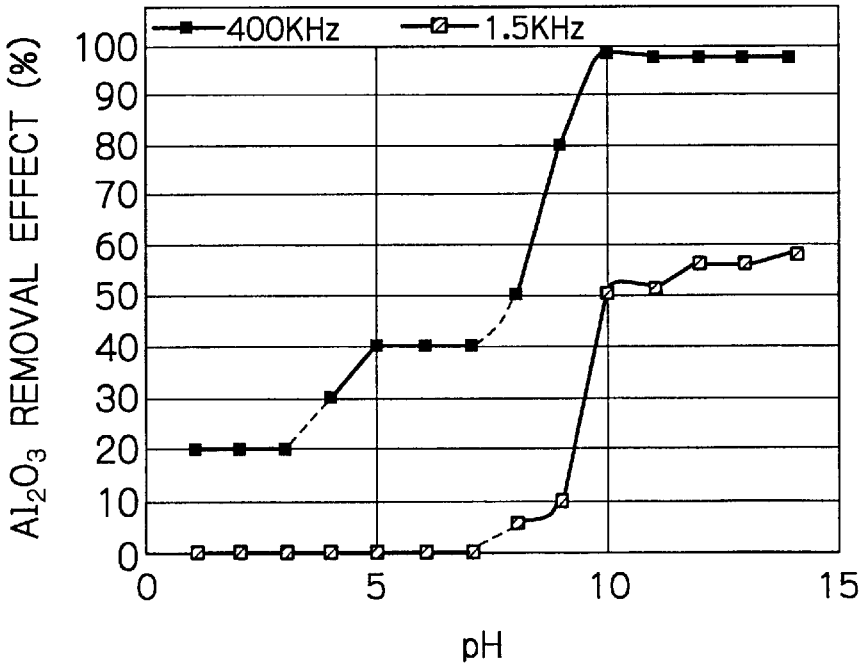
FIG. 11 is a diagram showing the importance of pH value in obtaining a satisfactory effect in the semiconductor substrate cleaning method according to the first embodiment of the present invention.

Such a cleaning effect is also dependent on the pH of a cleaning liquid employed. FIG. 11 shows the $Al_2O_3$ particle removing effect when, in the experimental conditions, the pH of the cleaning liquid was varied. The abscissa axis shows the pH of the cleaning liquid, and the ordinate axis shows the $Al_2O_3$ particle removing effect. FIG. 11 shows the $Al_2O_3$ particle removing effect for a wafer having recesses of a depth of 500 nm at two different ultrasonic frequencies, i.e. 400 kHz and 1.5 MHz. In the case of 400 kHz, a satisfactory particle removing effect is obtained when the pH is not less than 8, and more preferably is not less than 10. In the case of 1.5 MHz, on the other hand, a satisfactory removing effect cannot be obtained even when the pH is increased. It should be noted that no removing effect is demonstrated when the pH of the cleaning liquid is less than 7.

Figure 12A:
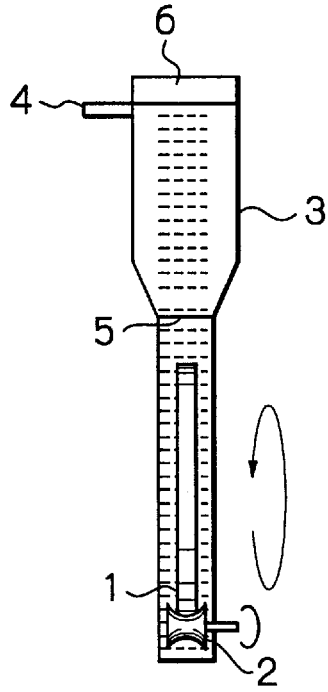
FIG. 12(*a*) is a front elevation view of a modification of the semiconductor substrate apparatus according to the first embodiment of the present invention.
Figure 12B:
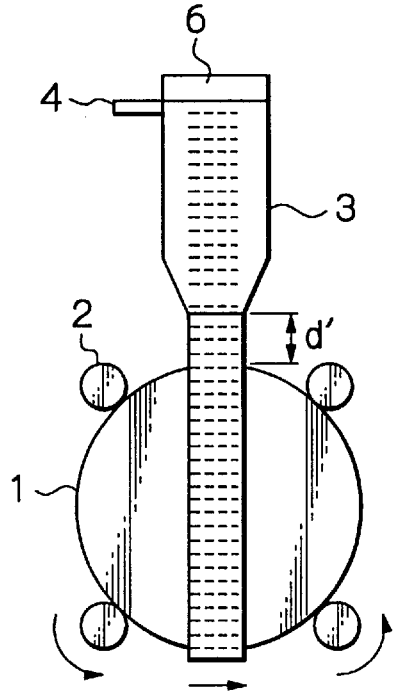

The present invention is not necessarily limited to the above-described embodiment. A modification of the first embodiment is shown in FIG. 12. In this modification, the wafer 1 is positioned vertically and the cleaning liquid is supplied thereto from the upper side thereof in a free fall manner. The arrangement of the rest of the apparatus is common to the modification and the above-described embodiment. In this modification, because the cleaning liquid falls freely, no problem arises even if the distance d' between the nozzle outlet 5 and the periphery of the wafer 1 is several tens of millimeters. Since the cleaning liquid is supplied in a free fall manner, the cleaning liquid can be sufficiently supplied to both the obverse and reverse sides of the wafer 1.

SECOND EMBODIMENT

Figure 13A:
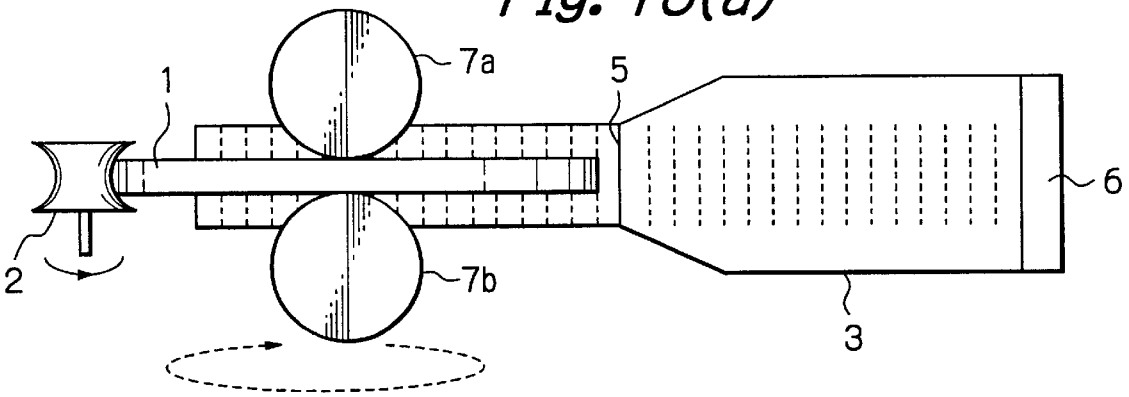
FIG. 13(*a*) is a side elevation view of a semiconductor substrate cleaning apparatus according to a second embodiment of the present invention.
Figure 13B:
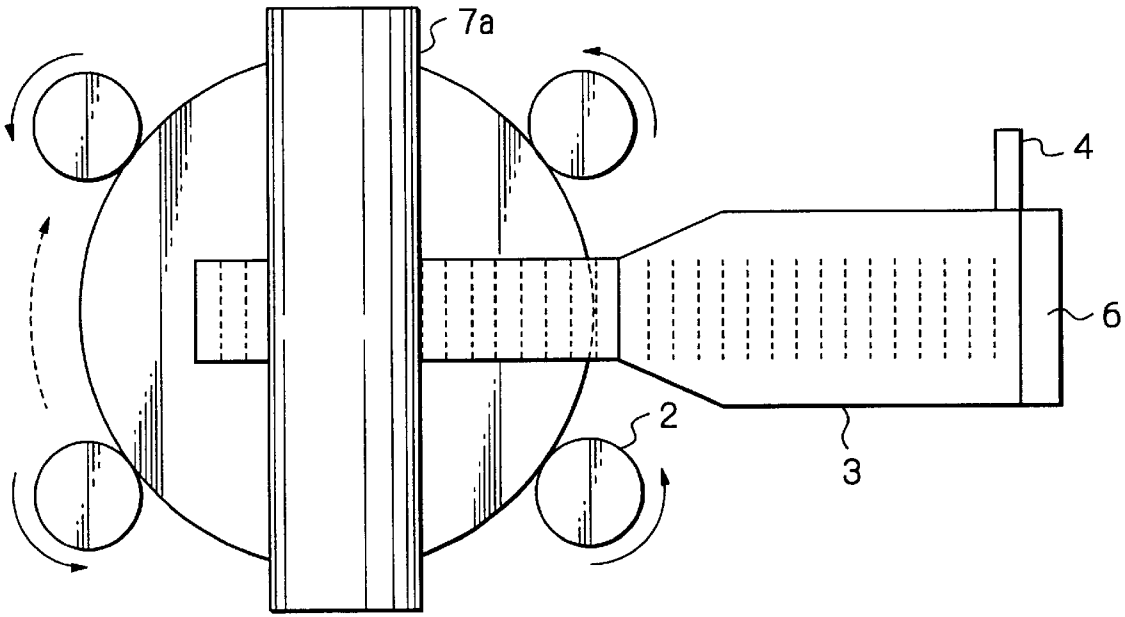

FIG. 13 is a diagram showing the general arrangement of a semiconductor substrate cleaning apparatus according to a second embodiment of the present invention, in which FIG. 13(*a*) is a side elevation view, and FIG. 13(*b*) is a plan view. In this embodiment, sponge cleaning rollers 7*a*, 7*b* are used in cooperation with the cleaning apparatus according to the first embodiment. Members or portions of the cleaning apparatus that are common to the first and second embodiments are denoted by the same reference numerals, and detailed description thereof is omitted.

As shown in FIG. 13*a*, the sponge cleaning rollers 7*a* and 7*b* are provided at the obverse and reverse sides of the wafer 1 so as to be able to advance towards and retract from the wafer 1. The sponge rollers 7*a* and 7*b* are adapted to sandwich the wafer 1 therebetween, with the rotating shafts of the driving rollers 2 being movable along the outer periphery of the wafer 1. That is, the driving rollers 2 are able to revolve about the center of the wafer 1. In other words, the positions at which the wafer 1 are engaged by the driving rollers 2 can be changed at all times by moving the driving rollers 2 around the wafer 1. It should be noted that the dotted lines in the figure show the travel paths of ultrasonic wavefronts as in the case of the first embodiment.

The operation of the semiconductor substrate cleaning apparatus according to this embodiment will be described below.

First, the wafer 1 is rotated by rotating the driving rollers 2. The sponge cleaning rollers 7*a* and 7*b* are pressed against the obverse and reverse sides, respectively, of the rotating wafer 1. Then, the sponge rollers 7*a* and 7*b* are rotated. At the same time as the sponge rollers 7*a* and 7*b* are pressed against both sides of the wafer 1, the ultrasonic vibration nozzle 3 is placed at a predetermined distance d from the periphery of the wafer 1, and the cleaning liquid direction angle relative to the surface of the wafer 1 is set at 0°. Then, the cleaning liquid is supplied to the wafer 1 from the liquid inlet 4 through the ultrasonic vibration nozzle 3. Both the obverse and reverse sides of the wafer 1 are soaked with the supplied cleaning liquid.

In this state, ultrasonic waves are generated from the ultrasonic vibrator 6. Consequently, the generated ultrasonic waves are propagated to the wafer 1 from the ultrasonic vibration nozzle 3 through the cleaning liquid. Thus, ultrasonic vibrations are applied to both the obverse and reverse sides of the wafer 1 simultaneously. The ultrasonic vibrations allow particles attached to the wafer 1 to be removed from both the obverse and reverse sides thereof simultaneously. In addition, because the sponge cleaning rollers 7*a* and 7*b* are rotated in press contact with the wafer 1, the cleaning effect is further enhanced. The rotating shafts of the driving rollers 2, which support the wafer 1, are moved along the outer periphery of the wafer 1 about the center of the wafer.

Thus, according to this embodiment, ultrasonic vibrations can be applied directly to both the obverse and reverse sides of the wafer simultaneously. Therefore, particles in the recesses on the obverse and reverse sides of the wafer can be removed effectively as in the case of the first embodiment. Moreover, because the ultrasonic cleaning operation is carried out in combination with the sponge roller cleaning operation, the cleaning effect is further enhanced. In addition, because the sponge roller cleaning process need not be carried out as an extra process, it is also possible to shorten the cleaning time.

Because the rotating shafts of the driving rollers 2 are moved along the outer periphery of the wafer 1 about the center of the wafer, the wafer 1 can be effectively cleaned as far as the peripheral edge thereof without interfering with the cleaning operation of the sponge rollers 7*a* and 7*b*.

It should also be noted that a spin chuck system is commonly employed for holding a wafer to be cleaned. With the spin chuck system, however, the wafer 1 is continuously gripped at certain fixed positions by the spin chucks during the cleaning process. Therefore, the portions of the wafer 1 that are gripped by the spin chucks cannot be cleaned. Moreover, it is impossible to install an ultrasonic vibration nozzle 3 in such a manner that it supplies a liquid imparted with ultrasonic vibrations to the wafer 1 from a side thereof, as the nozzle installed in this manner is incapable of cleaning portions of the wafer 1 that are shadowed by the spin chucks as well as portions gripped by the spin chucks.

In contrast, when the driving rollers 2 are used, the positions on the wafer 1 which the driving rollers engage are not fixed. Therefore, it is possible to clean the wafer 1 satisfactorily including positions at which the wafer 1 is held, that is, as far as the peripheral edge of the wafer 1, without interfering with the cleaning operation of the sponge rollers 7*a* and 7*b*. Accordingly, the particle removing effect is enhanced significantly.

Figure 14:
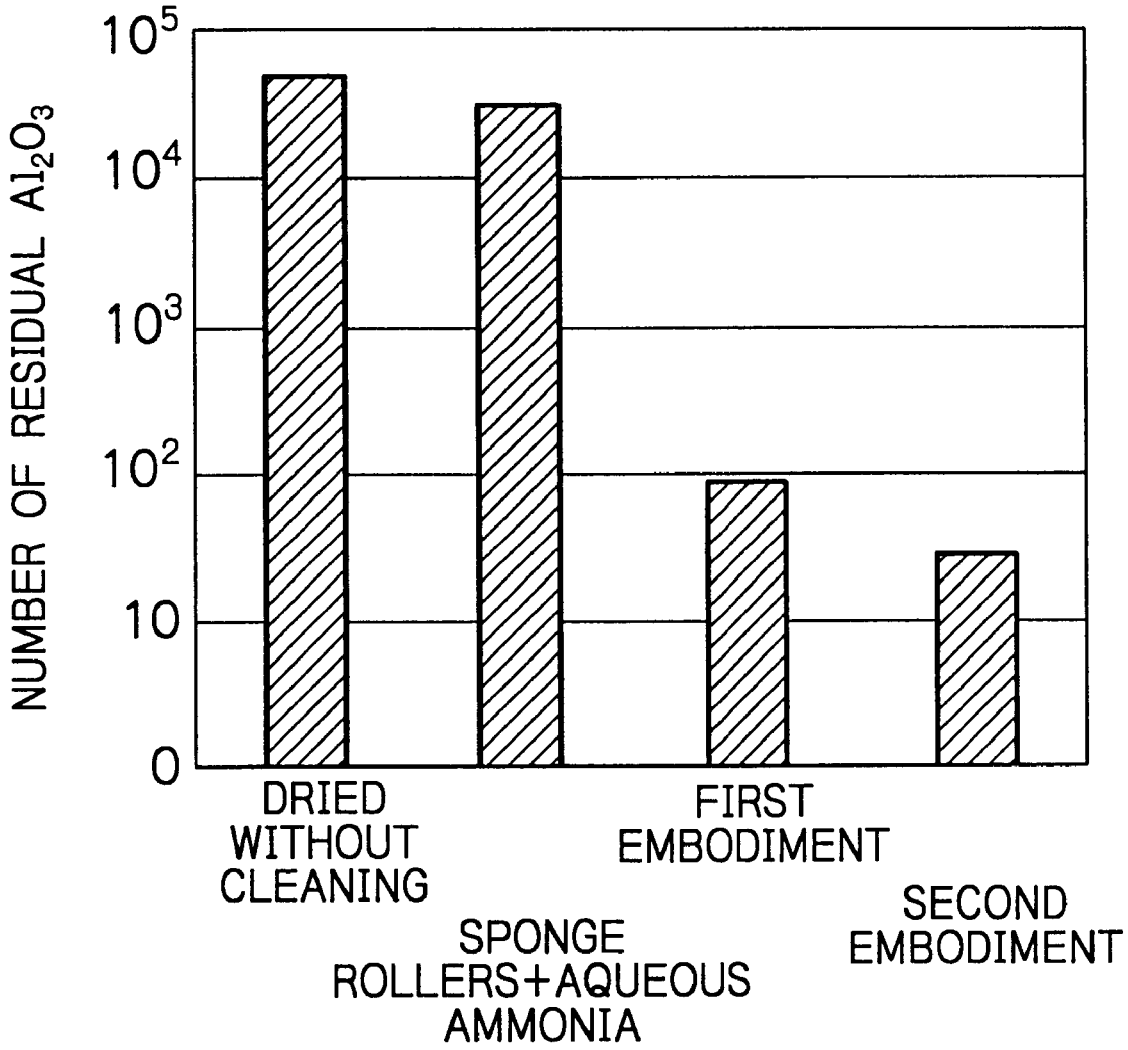
FIG. 14 is a comparative diagram showing the cleaning effects of the first and second embodiments of the present invention and that of a conventional cleaning apparatus.

FIG. 14 is a comparative diagram showing the cleaning effects of this embodiment and the first embodiment, and further the cleaning effect of a conventional cleaning apparatus. The ordinate axis shows the number of residual $Al_2O_3$ particles. FIG. 14 shows the alumina slurry removing effects of various cleaning processes for a wafer formed with recesses and having an alumina slurry adsorbed thereon. The wafer had a nitride film (LP-SiN film) deposited to a thickness of 0.2 micron in silicon trenches with a depth of 0.5 micron. AIT-8000 (manufactured by KLA-Tencor) was used for detecting slurry particles. When the wafer having an alumina CMP slurry adsorbed thereon was spin-dried without being cleaned, $4\times10^4$ to $5\times10^4$ slurry particles were detected. When the wafer was subjected to sponge roller cleaning for 1 minute using aqueous ammonia having a pH of about 10, $3\times10^4$ to $4\times10^4$ slurry particles were detected. That is, almost no cleaning effect was obtained. In contrast, when the wafer was subjected to ultrasonic cleaning according to the first embodiment, slurry particles were removed satisfactorily, and the number of residual slurry particles was reduced to within a region of several hundred. Thus, the recess cleaning effect obtained by ultrasonic cleaning is clearly evident. However, large alumina agglomerates adhering to the surface layer were not able to be removed. When ultrasonic cleaning and sponge roller cleaning were carried out simultaneously as in this embodiment, it was possible to remove alumina slurry particles and limit a number of residual particles to 100 or less. Thus, an advantageous effect produced by carrying out simultaneously contact cleaning and non-contact cleaning was manifested clearly, and the cleaning effect was demonstrated to be improved greatly in comparison with the process in which contact cleaning or non-contact cleaning was carried out singly. Further, the present invention enables a significant improvement in a cleaning effect obtained for a reverse side of the wafer, for which only sponge roller cleaning has been carried out in the conventional system.

THIRD EMBODIMENT

Figure 15A:
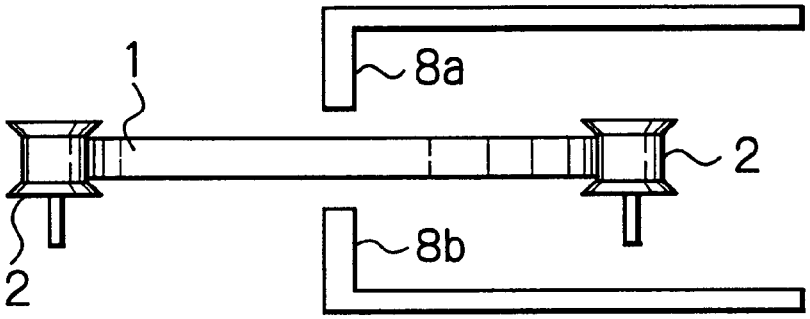
FIG. 15(*a*) is a side elevation view of a semiconductor substrate cleaning apparatus according to a third embodiment of the present invention.
Figure 15B:
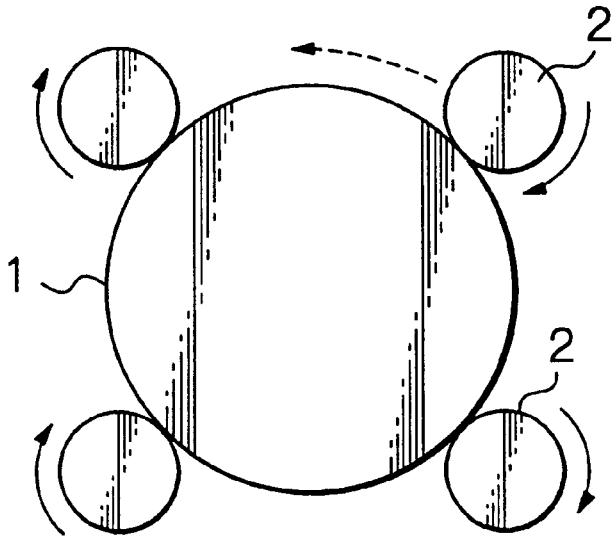

FIG. 15(*a*) is a side elevation view showing the general arrangement of a semiconductor substrate cleaning apparatus according to a third embodiment of the present invention.

As shown in FIG. 15(*a*), a plurality of driving rollers 2 are disposed along the outer periphery of a wafer 1 in the form of a disc. The driving rollers 2 contact the peripheral edge of the wafer 1 to horizontally support the wafer 1. The driving rollers 2 are members rotatable about respective rotating shafts which rotate the wafer. Chemical cleaning liquid supply nozzles 8*a* and 8*b* are provided to supply a chemical cleaning liquid to the central portion of each of the obverse and reverse sides of the wafer 1.

FIG. 15(*b*) is a diagram showing the wafer 1 and the driving rollers 2 as viewed from above. The driving rollers 2 rotate at the same number of revolutions in the respective directions of the solid-line arrows. Such an arrangement causes the wafer 1 to rotate in a direction designated by a dotted line arrow about the center of the wafer.

Figure 16:
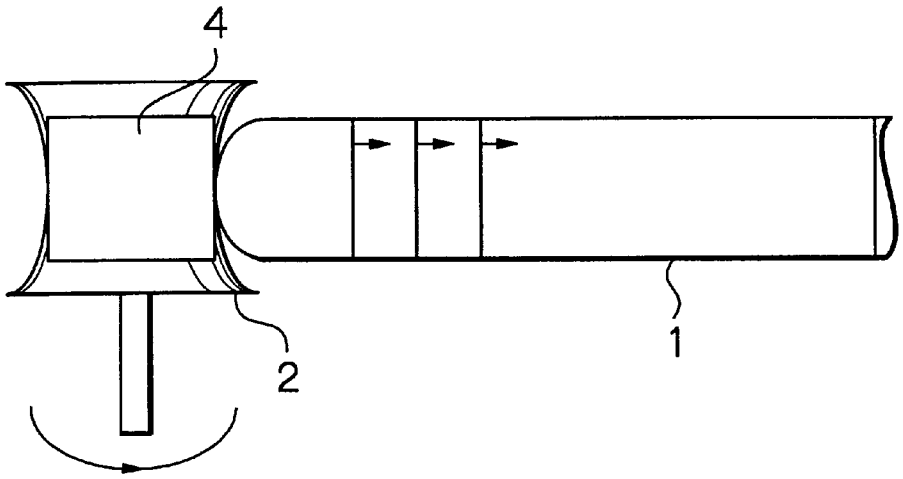
FIG. 16 is a diagram showing an essential part of the semiconductor substrate cleaning apparatus according to the third embodiment of the present invention.

FIG. 16 is an enlarged view of one of the driving roller 2 shown in FIG. 15 and its vicinities. The driving roller 2 incorporates an ultrasonic vibrator 4. As stated above, there are provided four driving rollers 2 each incorporating an ultrasonic vibrator 4. The wafer contact surface of each driving roller 2 is so structured that the ultrasonic vibrator 4 contacts the wafer 1 directly. In this case, at the area of contact between the wafer 1 and the ultrasonic vibrator 4, it is necessary only that at least the peripheral edge of the wafer 1 be in contact with the ultrasonic vibrator 4. By virtue of the structure in which the ultrasonic vibrator 4 is in direct contact with the bevel end of the wafer 1, ultrasonic vibrations generated from the ultrasonic vibrator 4 are imparted directly to the wafer 1. It should be noted that in FIG. 16 the arrows in the wafer 1 indicate the direction of travel of the ultrasonic waves.

The operation of the semiconductor substrate cleaning apparatus according to this embodiment will be described below.

First, as a primary cleaning process, the wafer 1 is held by the driving rollers 2 at a plurality of points on the peripheral edge thereof and rotated. While a cleaning liquid is being supplied to the rotating wafer 1, sponge rollers (not shown) are pressed against the obverse and reverse sides of the wafer 1. The sponge rollers are rotated to scan in such a manner as to sandwich the wafer 1 therebetween, thereby removing particles from the obverse and reverse sides of the wafer 1.

Next, the wafer 1 is rotated by rotating the driving rollers 2 as in the case of the primary cleaning process. Then, the obverse and reverse sides of the rotating wafer 1 are simultaneously supplied with a cleaning liquid from the chemical liquid supply nozzles 8*a* and 8*b*. Simultaneously, ultrasonic waves are generated from the ultrasonic vibrators 4 provided in the driving rollers 2. Consequently, ultrasonic vibrations are imparted directly to the wafer 1. The vibrations travel in the direction indicated by the arrows in FIG. 16, that is, in the diametrical direction of the wafer 1. Thus, cleaning is carried out in a state where ultrasonic vibrations are imparted directly to the wafer 1, and removal of particles attached to the obverse and reverse sides of the wafer 1 is achieved satisfactorily.

Figure 17:
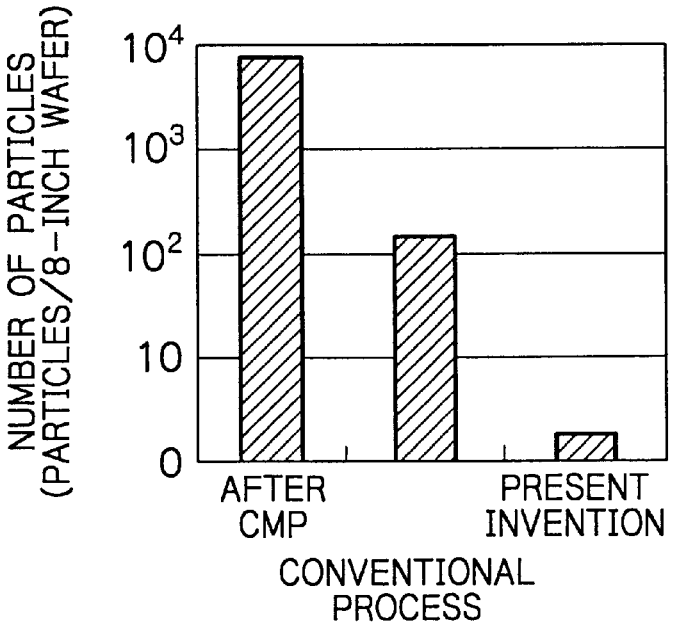
FIG. 17 is a comparative diagram showing the cleaning effects of the semiconductor substrate cleaning method according to the third embodiment of the present invention and those of a conventional cleaning method.

FIG. 17 shows the particle removing effect in regard to the wafer 1 cleaned by the above-described process. FIG. 17 shows the number of residual particles when the surface of an 8-inch wafer 1 was subjected to CMP (Chemical/Mechanical Polishing). For comparative purposes, FIG. 17 also shows the number of residual particles existing immediately after CMP and the number of particles remaining after the conventional wafer cleaning process has been carried out. In the conventional wafer cleaning process, scanning-type ultrasonic cleaning was carried out at 1.6 MHz. As shown in FIG. 17, the number of particles attached to the wafer 1 immediately after CMP, i.e. $10^4$, was reduced to about $10^2$ by the conventional wafer cleaning process. It has been found that the particle removing effect of the conventional wafer cleaning process is not sufficiently effective in removing large particles of 0.5 micrometers or more in size. In contrast, the wafer cleaning process .according to this embodiment exhibits a superior particle removing effect with respect to particles of 0.1 micrometer or more in size, and including such large particles thus enabling a reduction in the number of residual particles to a satisfactorily low number.

As stated above, according to this embodiment, ultrasonic vibrations are imparted directly to the wafer 1 in the diametrical direction of the wafer. Moreover, because the chemical liquid supply nozzles 8*a* and 8*b* are provided for both the obverse and reverse sides of the wafer 1, the obverse and reverse sides of the wafer 1 can be supplied with a chemical liquid simultaneously. Accordingly, the obverse and reverse sides of the wafer 1 can be cleaned simultaneously, and the cleaning time can be shortened.

Figure 18:
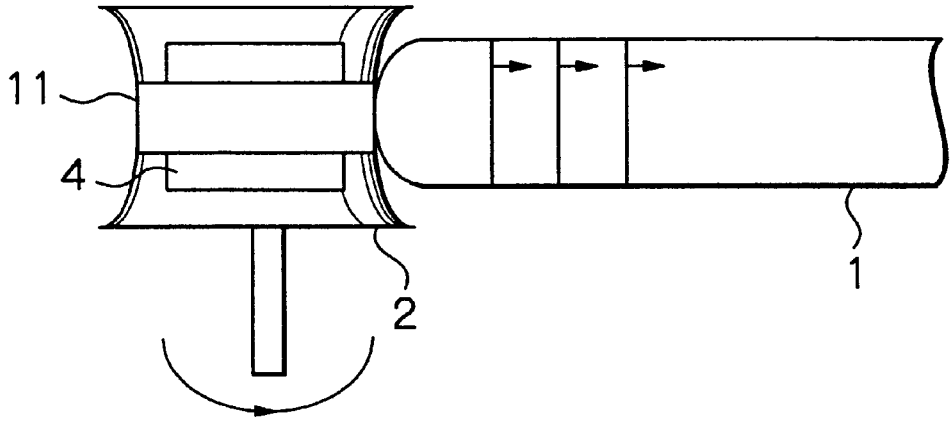
FIG. 18 is a diagram showing a modification of the semiconductor substrate cleaning apparatus according to the third embodiment of the present invention.

The present invention is not necessarily limited to the above-described third embodiment. Although in this embodiment the ultrasonic vibrators 4 provided in the driving rollers 2 are brought into direct contact with the wafer 1 as shown in FIG. 16, the arrangement may be such that, as shown in FIG. 18 by way of example, a protective plate 11 is provided on the surface of each driving roller 2 so that the ultrasonic vibrator 4 and the wafer 1 come into contact with each other by way of the protective plate 11. The provision of the protective plate 11 improves the chemical resistance of the ultrasonic vibrator 4 and the driving roller 2. As the protective plate 11, a sheet of silicon carbide (SiC) or quartz (SiO2), for example, can be used. However, the protective plate 11 is not necessarily limited to these materials.

In addition, the cleaning process of the third embodiment can be combined with the cleaning process effected by means of sponge rollers as explained in connection with the second embodiment.

FOURTH EMBODIMENT

Figure 19:
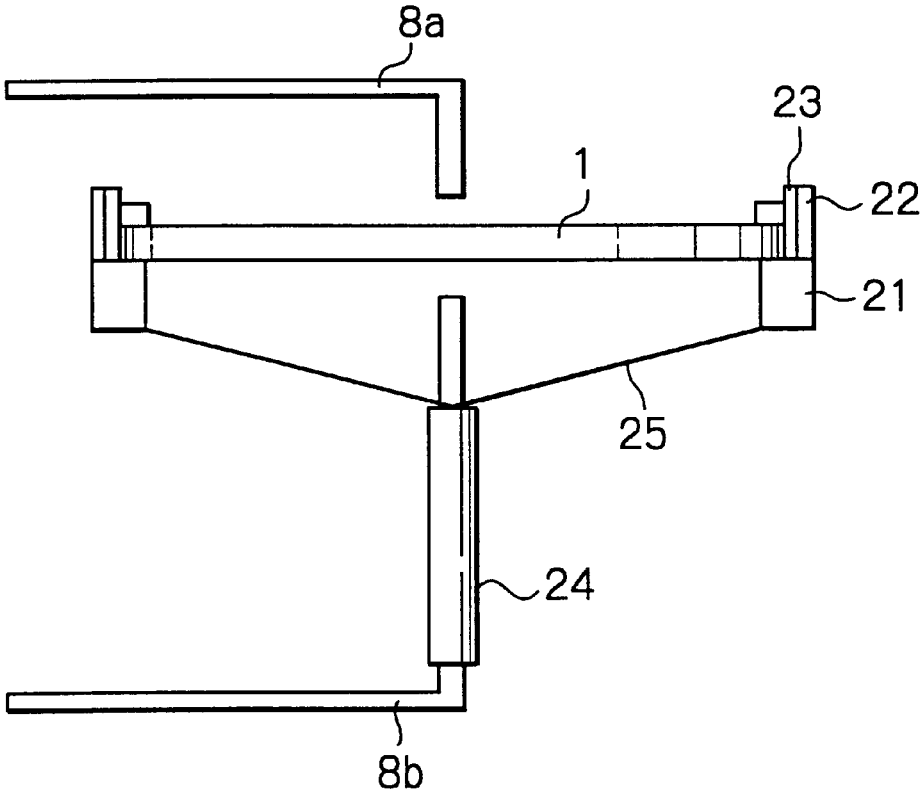
FIG. 19 is a diagram showing the general arrangement of a semiconductor substrate cleaning apparatus according to a fourth embodiment of the present invention.
Figure 20:
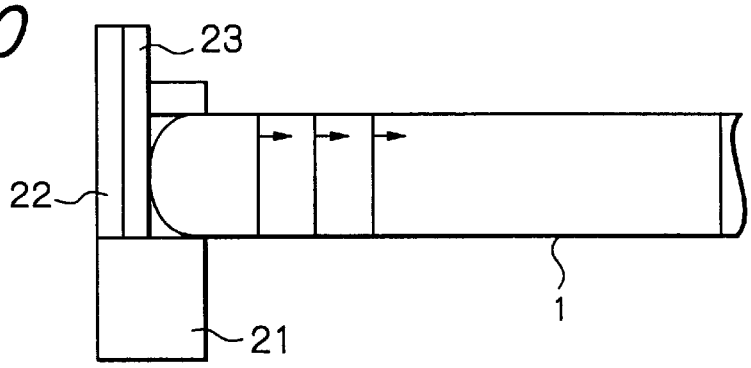
FIG. 20 is an enlarged view of an essential part of the semiconductor substrate cleaning apparatus according to the fourth embodiment of the present invention.
Figure 21:
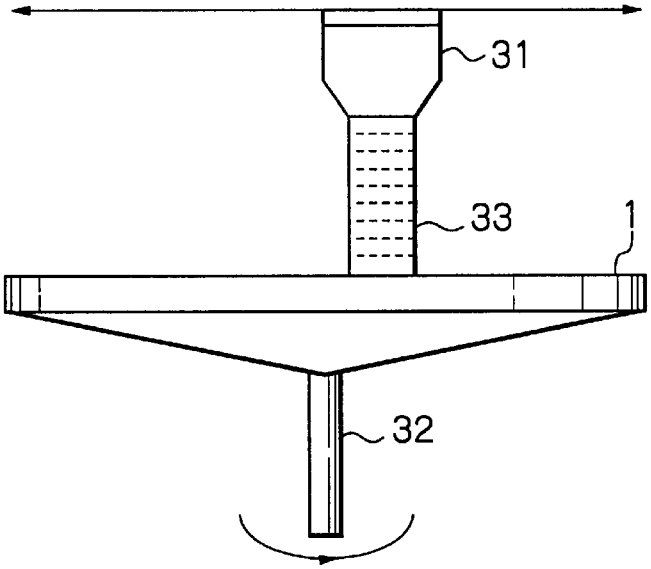
FIG. 21 is a schematic view of a conventional semiconductor substrate cleaning apparatus using a single ultrasonic nozzle.
Figure 22:
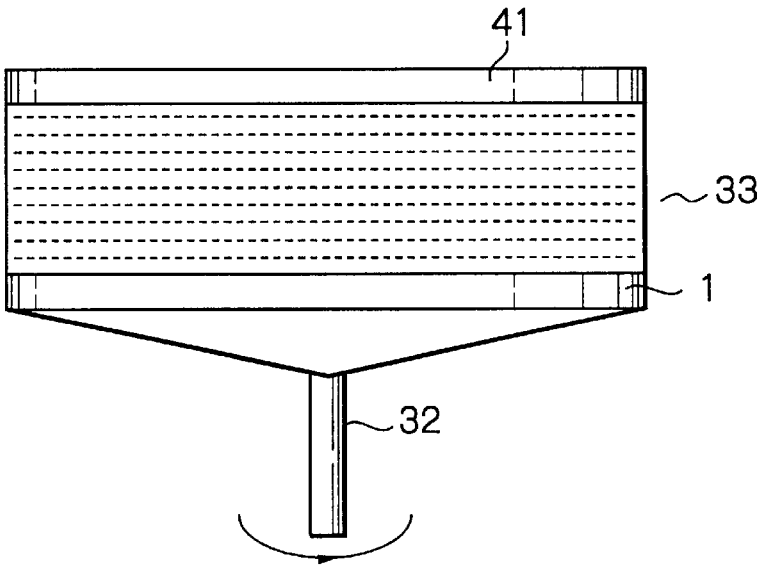
FIG. 22 is a schematic view of a conventional semiconductor substrate cleaning apparatus using a rod-shaped ultrasonic vibrator.

FIG. 19 is a diagram showing the general arrangement of a semiconductor substrate cleaning apparatus according to a fourth embodiment of the present invention. FIG. 20 is an enlarged view of an essential part of the cleaning apparatus according to the fourth embodiment.

As shown in FIG. 19, chemical liquid supply nozzles 8*a* and 8*b* are provide for the obverse and reverse sides, respectively, of the wafer 1 as in the case of the third embodiment. The wafer 1 is held by a wafer holder 21. In addition, a plurality of chuck pins 22 for determining the horizontal position of the wafer 1 are disposed to contact the peripheral edge of the wafer 1 through ultrasonic vibrators 23. The chuck pins 22 grip the wafer 1 at the same positions continuously during the cleaning process. However, in a case where a plurality of vibrators 23 are installed at the wafer holding portions of a plurality of chuck pins 22, the vibrators 23 interfere with each other thereby causing deterioration in vibration intensity. It should be noted that the ultrasonic vibrators 23 should not be installed in point symmetry with respect to the center of the wafer 1.

A cylindrical rotating member 24 is rotatably provided on a base portion of the chemical liquid supply nozzle 8*b*, which is provided at the reverse side of the wafer 1. A support member 25 is secured to the upper end of the rotating member 24 to support the wafer holder 21. As the rotating member 24 rotates around the chemical liquid supply nozzle 8*b*, the wafer holder 21 rotates about the axis of rotation of the rotating member 24 as the center axis, thereby allowing the wafer 1 to be rotated.

Thus, even in a case where a spin chuck system is used as a mechanism for holding the wafer 1 as in this embodiment, both the obverse and reverse sides of the wafer 1 can be cleaned simultaneously as in the case of the third embodiment.

The present invention is not necessarily limited to the above-described embodiments. The object to be cleaned is not limited to silicon wafers. The present invention is applicable to any type of semiconductor substrate irrespective of the material thereof. The number of driving rollers 2 is not limited to four but may be any number as long as the wafer 1 can be satisfactorily retained. However, it is preferable to set the number of driving rollers 2 so that the cleaning operation of the sponge rollers 7*a* and 7*b* is not restricted by the driving rollers 2.

As has been detailed above, according to the present invention, the cleaning liquid supplied from the cleaning liquid supply nozzle soaks both the obverse and reverse sides of a semiconductor substrate, and ultrasonic vibrations are imparted to both the obverse and reverse sides of the semiconductor substrate. Therefore, the obverse and reverse sides of the semiconductor substrate can be cleaned simultaneously, and the cleaning time can be shortened. Moreover, because the cleaning liquid is supplied from the nozzle, it is possible to minimize the amount of chemical liquid used as compared to the dip-type cleaning system in which an entire semiconductor substrate is dipped in the cleaning liquid.

What is claimed is:

1. A cleaning apparatus for cleaning a semiconductor substrate having an obverse side, a reverse side, and a peripheral edge, the cleaning apparatus comprising:

a cleaning liquid supply nozzle for supplying a cleaning liquid to both the obverse side and the reverse side of the semiconductor substrate; and an ultrasonic vibrator arranged to contact the semiconductor substrate so as to impart ultrasonic vibrations directly to both the obverse side and the reverse side of the semiconductor substrate.

2. A cleaning apparatus according to claim 1, wherein said cleaning liquid supply nozzle is placed outside the peripheral edge of the semiconductor substrate and has a cleaning liquid outlet for directing a cleaning liquid towards the peripheral edge of the semiconductor substrate so that the cleaning liquid is supplied to both the obverse side and the reverse side of the semiconductor substrate; and said ultrasonic vibrator is adapted to generate and impart ultrasonic vibrations directly to the semiconductor substrate and through the cleaning liquid discharged from said cleaning liquid outlet of said cleaning liquid supply nozzle and supplied to the semiconductor substrate.

3. A cleaning apparatus according to claim 2, further comprising:

a pair of sponge rollers adapted to be brought into contact with the obverse side and the reverse side of the semiconductor substrate to sandwich the semiconductor substrate, said pair of sponge rollers being rotatable to remove contamination from the surface of the semiconductor substrate with which the sponge rollers are in contact.

4. A cleaning apparatus according to claim 1, further comprising a plurality of driving rollers adapted to engage the peripheral edge of a disc-shaped semiconductor substrate, and each of said driving rollers having a central roller axis and being operable to rotate about the central roller axis so as to rotate the disc-shaped semiconductor substrate.

5. A cleaning apparatus according to claim 1, further comprising:

a sponge roller adapted to be brought into contact with either one of the obverse side and the reverse side of the semiconductor substrate, said sponge roller being rotatable to remove contamination from the surface of the semiconductor substrate with which the sponge roller is in contact.

6. A cleaning apparatus according to claim 1, wherein said ultrasonic vibrator is operable to generate vibrations in a range of from 200 kHz to 700 kHz.

7. A cleaning apparatus for cleaning a semiconductor substrate having an obverse side, a reverse side, and a peripheral edge, the cleaning apparatus comprising:

at least one cleaning liquid supply nozzle for supplying a cleaning liquid to both the obverse side and the reverse side of the semiconductor substrate; and an ultrasonic vibrator arranged to contact the semiconductor substrate so as to impart ultrasonic vibrations directly to both the obverse side and the reverse side of the semiconductor substrate.

8. A cleaning apparatus according to claim 7, wherein said ultrasonic vibrator has a cylindrical surface to be directly engaged with the semiconductor substrate.

9. A cleaning apparatus according to claim 7, further comprising a plurality of driving rollers adapted to engage the peripheral edge of a disc-shaped semiconductor substrate, and each of said driving rollers having a central roller axis and being operable to rotate about the central roller axis so as to rotate the disc-shaped semiconductor substrate, wherein said ultrasonic vibrator is embedded in at least one of said driving rollers.

10. A leaning apparatus according to claim 7, further comprising:

a sponge roller adapted to be brought into contact with either one of the obverse side and the reverse side of the semiconductor substrate, said sponge roller being rotatable to remove contamination from the surface of the semiconductor substrate with which the sponge roller is in contact.

11. A cleaning apparatus according to claim 7, further comprising:

a pair of sponge rollers adapted to be brought into contact with the obverse side and the reverse side of the semiconductor substrate to sandwich the semiconductor substrate, said pair of sponge rollers being rotatable to remove contamination from the surface of the semiconductor substrate with which the sponge rollers are in contact.

12. A cleaning apparatus according to claim 7, wherein said ultrasonic vibrator is operable to generate vibrations in a range of from 200 kHz to 700 kHz.

13. A cleaning apparatus for cleaning a disc-shaped semiconductor substrate having an obverse side, a reverse side, and a peripheral edge, the cleaning apparatus comprising:

at least one cleaning liquid supply nozzle for supplying a cleaning liquid to both the obverse side and the reverse side of the disc-shaped semiconductor substrate;

an ultrasonic vibrator for imparting ultrasonic vibrations to both the obverse side and the reverse side of the disc-shaped semiconductor substrate; and a plurality of driving rollers adapted to engage the peripheral edge of the disc-shaped semiconductor substrate, and each of said driving rollers having a central roller axis and being operable to rotate about the central roller axis so as to rotate the disc-shaped semiconductor substrate, wherein said ultrasonic vibrator is incorporated into at least one of said driving rollers so as to transmit ultrasonic vibrations to the disc-shaped semiconductor substrate through the driving roller.

14. A cleaning apparatus according to claim 13, wherein said ultrasonic vibrator has a cylindrical surface to be directly engaged with the semiconductor substrate.

15. A cleaning apparatus according to claim 13, wherein said ultrasonic vibrator is embedded in at least one of said driving rollers.

16. A cleaning apparatus according to claim 13, further comprising:

a sponge roller adapted to be brought into contact with either one of the obverse side and the reverse side of the semiconductor substrate, said sponge roller being rotatable to remove contamination from the surface of the semiconductor substrate with which the sponge roller is in contact.

17. A cleaning apparatus according to claim 13, further comprising;

a pair of sponge rollers adapted to be brought into contact with the obverse side and the reverse side of the semiconductor substrate to sandwich the semiconductor substrate, said pair of sponge rollers being rotatable to remove contamination from the surface of the semiconductor substrate with which the sponge rollers are in contact.

18. A cleaning apparatus according to claim 13, wherein said ultrasonic vibrator is operable to generate vibrations in a range of from 200 kHz to 700 kHz.

* * * * *